US009065172B2

(12) United States Patent
Lewry et al.

(10) Patent No.: US 9,065,172 B2
(45) Date of Patent: Jun. 23, 2015

(54) MOUNTING HUB FOR ANTENNA

(71) Applicant: Andrew LLC, Hickory, NC (US)

(72) Inventors: Matthew R Lewry, Limekilns-Fife (GB); Douglas P Hunter, Thornton-Fife (GB); Alastair D Wright, Edinburgh (GB)

(73) Assignee: CommScope Technologies LLC, Hickory, NC (US)

( * ) Notice: Subject to any disclaimer, the term of this patent is extended or adjusted under 35 U.S.C. 154(b) by 229 days.

(21) Appl. No.: 13/900,781

(22) Filed: May 23, 2013

(65) Prior Publication Data

US 2014/0347246 A1 Nov. 27, 2014

(51) Int. Cl.
*H01Q 1/12* (2006.01)

(52) U.S. Cl.
CPC ..... *H01Q 1/1242* (2013.01); *Y10T 29/4998* (2015.01)

(58) Field of Classification Search
CPC ..... H01Q 1/1242
USPC ..... 343/781 P, 878, 890, 892, 912, DIG. 2
See application file for complete search history.

(56) References Cited

U.S. PATENT DOCUMENTS

| | | | | |
|---|---|---|---|---|
| 5,402,139 | A * | 3/1995 | Maeshima | 343/840 |
| 5,508,712 | A | 4/1996 | Tom et al. | |
| 5,867,132 | A | 2/1999 | Blasing et al. | |
| 5,988,583 | A | 11/1999 | Rhine | |
| 6,031,508 | A * | 2/2000 | Ishizuka et al. | 343/882 |
| 6,107,973 | A | 8/2000 | Knop et al. | |
| 6,262,691 | B1 | 7/2001 | Austin et al. | |
| 6,404,400 | B1 * | 6/2002 | Tulloch | 343/765 |
| 6,469,679 | B2 * | 10/2002 | Yoshida et al. | 343/892 |
| 6,985,057 | B2 | 1/2006 | Lesutis | |
| 7,106,273 | B1 * | 9/2006 | Brunson et al. | 343/890 |
| 7,173,575 | B2 | 2/2007 | Brooker | |
| 7,802,370 | B2 | 9/2010 | Lewry et al. | |
| 7,898,491 | B1 | 3/2011 | Curran et al. | |
| 8,698,683 | B2 * | 4/2014 | Syed et al. | 343/756 |
| 8,780,008 | B2 * | 7/2014 | Lettkeman et al. | 343/878 |
| 2006/0001589 | A1 | 1/2006 | Nicolae | |
| 2007/0132655 | A1 | 6/2007 | Lin | |
| 2011/0074652 | A1 | 3/2011 | Lewry et al. | |
| 2011/0267243 | A1 | 11/2011 | Steinkamp et al. | |

FOREIGN PATENT DOCUMENTS

| | | |
|---|---|---|
| JP | 7-58532 | 3/1995 |
| WO | WO96/39726 | 12/1996 |

OTHER PUBLICATIONS

Sung Chul Kang, International Search Report for PCT application PCT/US2014/020473, Jun. 13, 2014, Daejeon Metropolitan City, Republic of Korea.

* cited by examiner

*Primary Examiner* — Tho G Phan
(74) *Attorney, Agent, or Firm* — Babcock IP, PLLC

(57) ABSTRACT

An antenna hub for a reflector dish has a frame with a feed aperture. A plurality of feet are coupled to the frame; each of the feet provided with a dish fastener coupling axis normal to a dish surface contacting each of the feet when the reflector dish is seated upon the feet, the feed bore of the reflector dish aligned coaxial with the feed aperture. The frame and feet may be formed via extrusion.

20 Claims, 6 Drawing Sheets

MOUNTING HUB FOR ANTENNA

BACKGROUND

1. Field of the Invention

This invention relates to antennas. More particularly, the invention relates to a mounting hub for coupling the antenna assembly, signal processing equipment and/or a mounting bracket of the antenna assembly to one another.

2. Description of Related Art

Reflector Antennas utilize a reflector dish to focus an RF signal upon a feed assembly such as a subreflector, waveguide and/or feed. The reflector dish, feed assembly and signal processing equipment such as a transceiver are typically coupled to one another via a mounting hub. Prior mounting hubs 8, for example as shown in FIGS. 1 and 2, have typically been provided for mating between a specific antenna mounting bracket 4, and reflector antenna 6, configured for unique dimensions of the reflector dish 10 and feed support plate combination, so that the mating points between the mounting hub 8 and the reflector dish 10 securely mate with the contours of the reflector dish 10, without deforming the reflector dish 10, and also present the end of the feed support plate at a specific orientation and depth with respect to mounting surfaces provided on the mounting hub 8 for the signal processing equipment.

When the diameter, depth and/or curvature applied to the reflector dish 10 changes between antenna models, a separate mounting hub 8 specific to each reflector dish 10 and/or feed assembly combination may be required. Prior mounting hubs 8 have typically been fabricated via three-dimensional precision machining of a solid block or casting blank of metal material, consuming significant time and material expense.

Further, the mounting hub 8 may be a significant portion of the total weight of the antenna assembly, increasing the requirements for antenna towers the antenna assembly may be mounted upon.

Competition in the antenna mount market has focused attention on minimizing overall manufacturing, inventory, distribution, installation and maintenance costs. Therefore, it is an object of the invention to provide a reflector antenna mount that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that a hub mount may be formed from a common base frame provided with feet of varying dimensions, the frame and/or feet fabricated via two-dimensional methods, such as extrusion, to provide hub mounts for use with a wide range of reflector dish dimensions. Thereby the hub mount weight and hub mount manufacture, material and/or inventory costs may be reduced.

Figure 1:
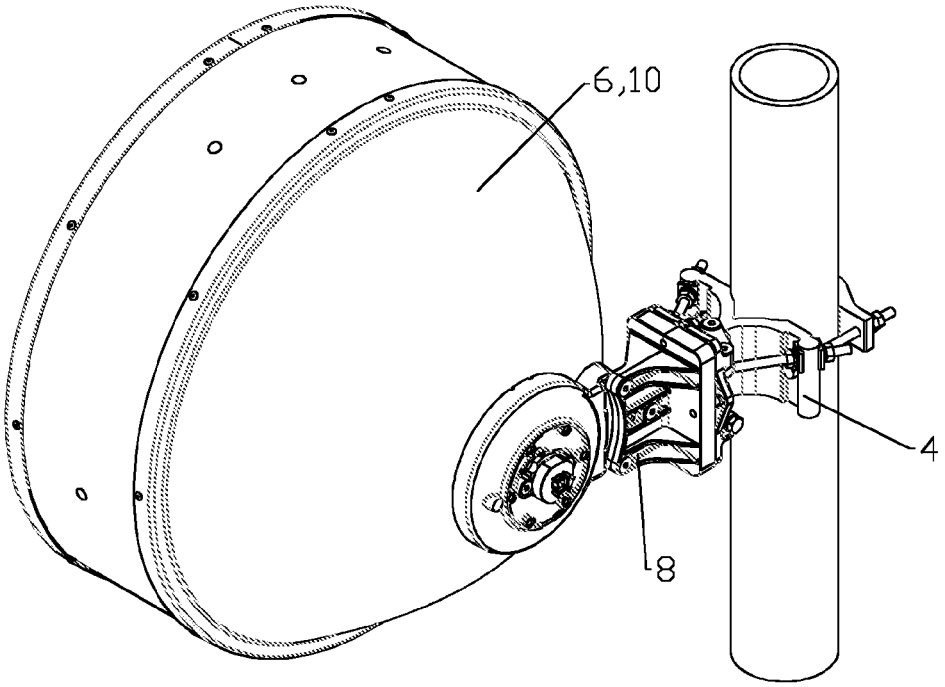
Fig. 1 (Prior Art)
FIG. 1 is a schematic isometric view of a prior art antenna assembly.
Figure 2:
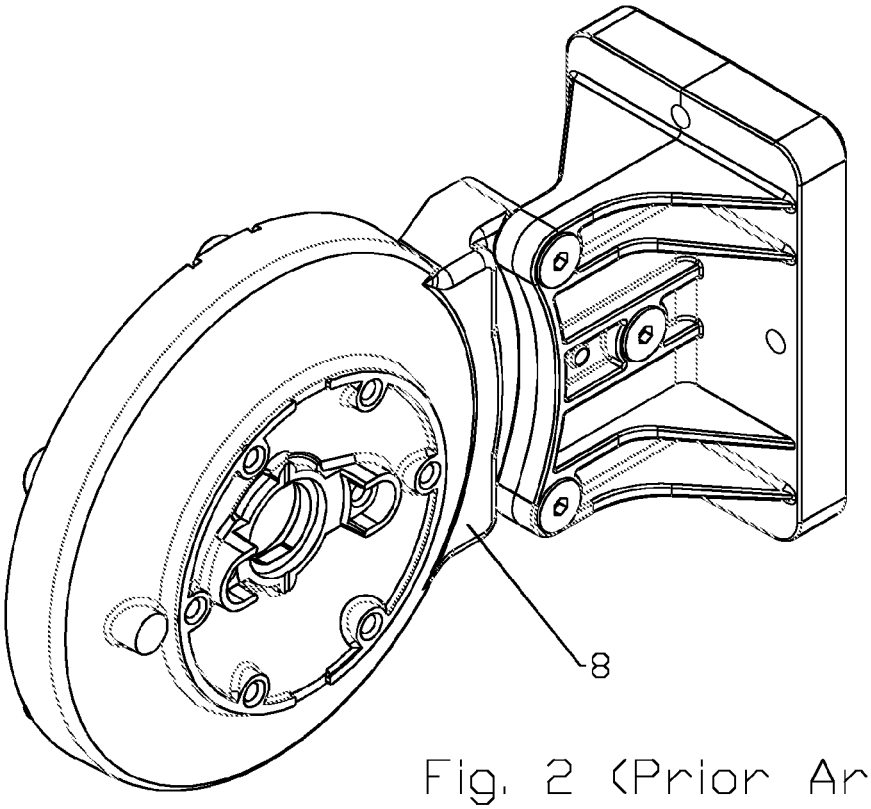
Fig. 2 (Prior Art)
FIG. 2 is a schematic isometric view of the mounting hub of FIG. 1.
Figure 3:
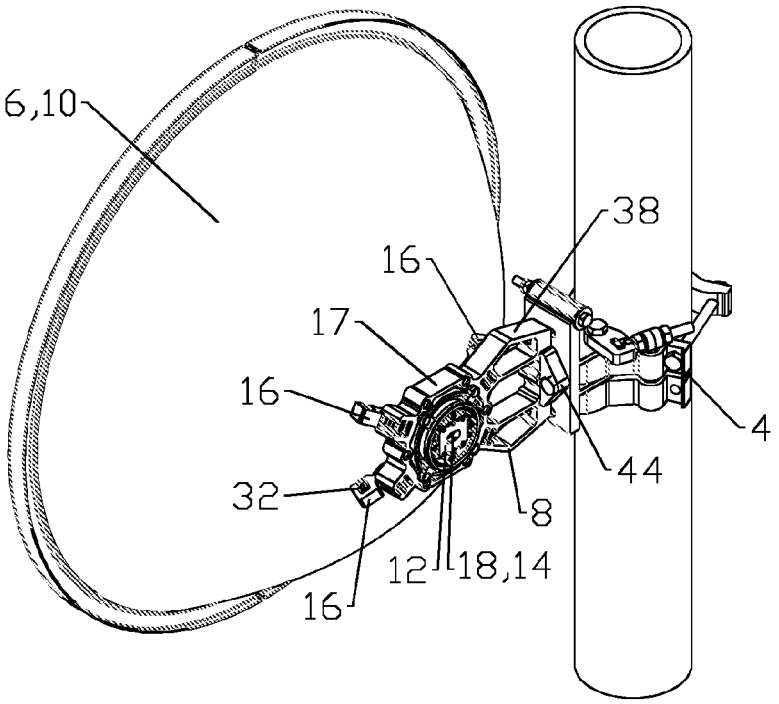
FIG. 3 is a schematic top view of an antenna assembly with an exemplary mounting hub.
Figure 4:
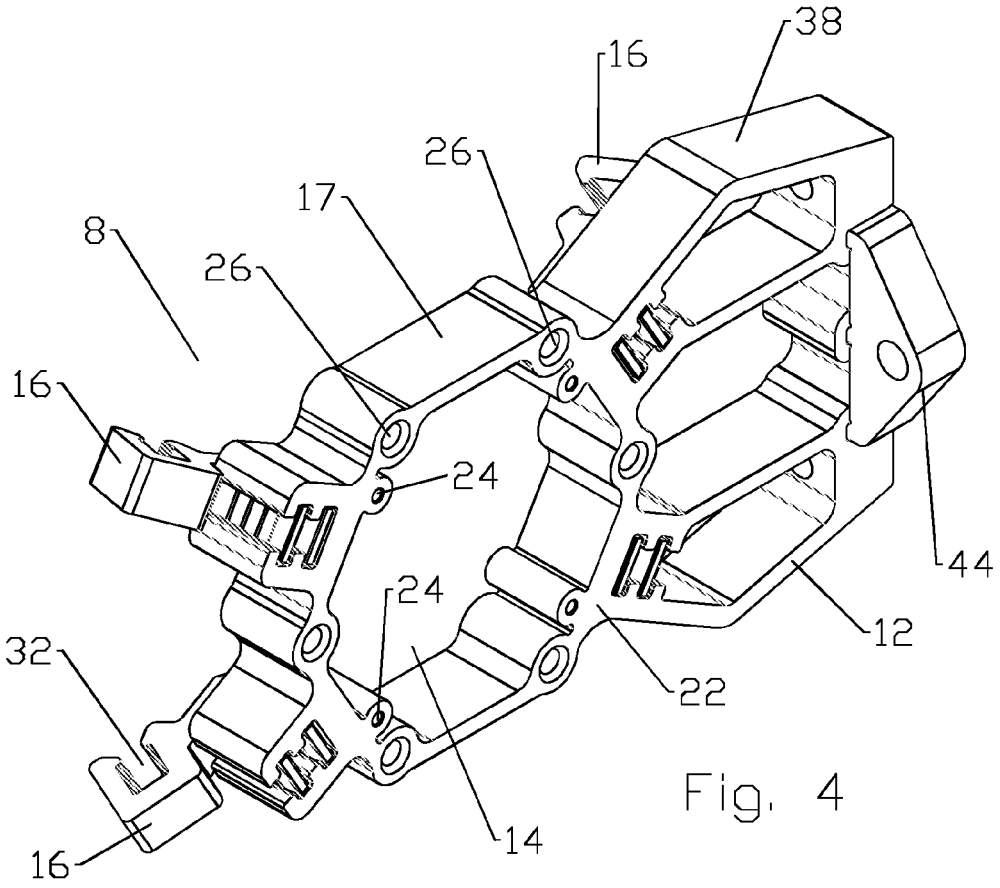
FIG. 4 is a schematic isometric view of the mounting hub of FIG. 3.
Figure 5:
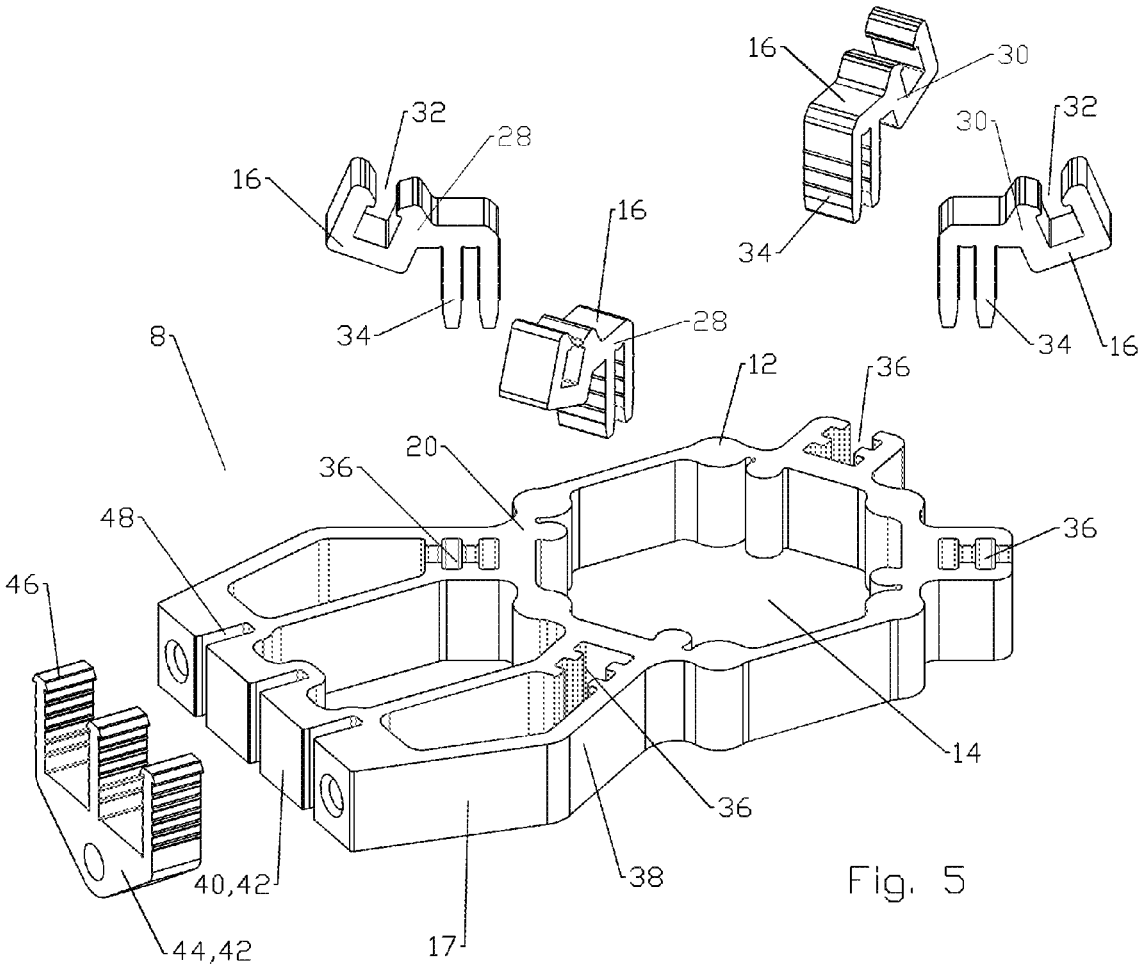
FIG. 5 is a schematic isometric exploded view of the frame of the mounting hub of FIG. 4.
Figure 6:
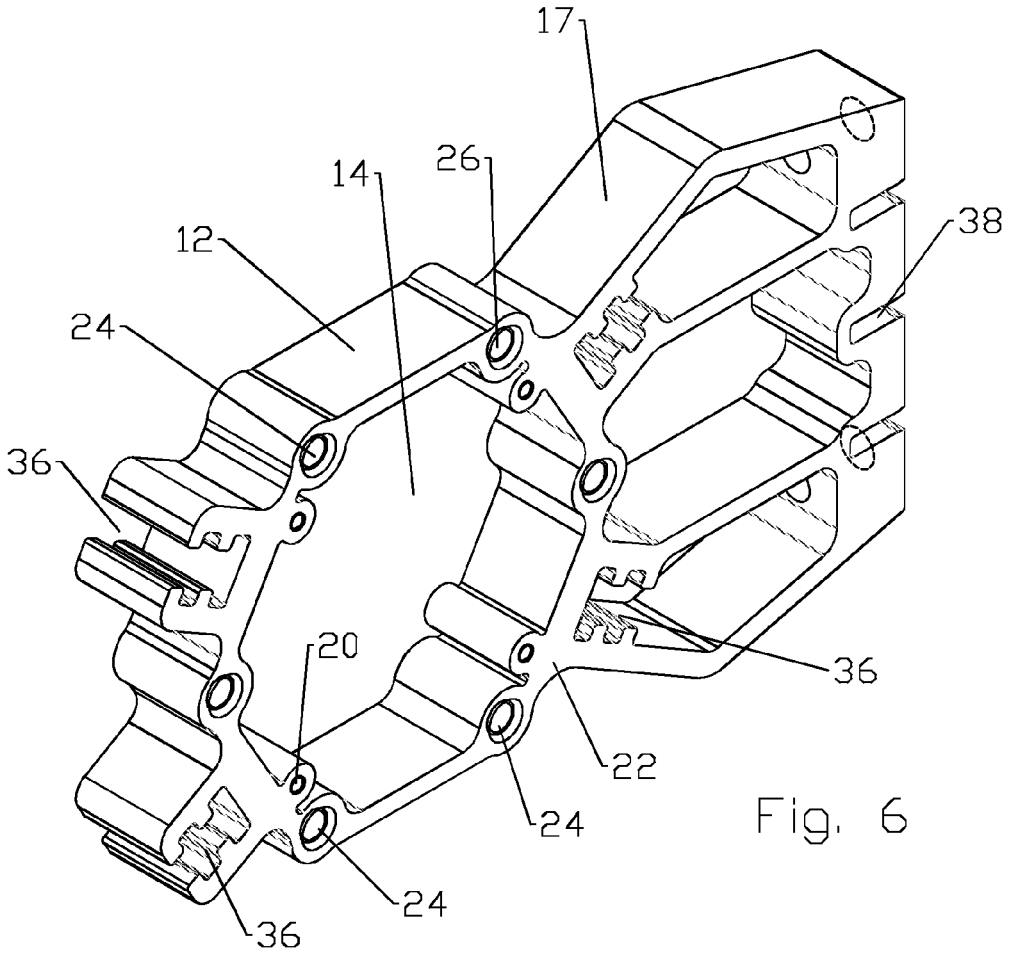
FIG. 6 is a schematic isometric view of the frame of the mounting hub of FIG. 4.
Figure 7:
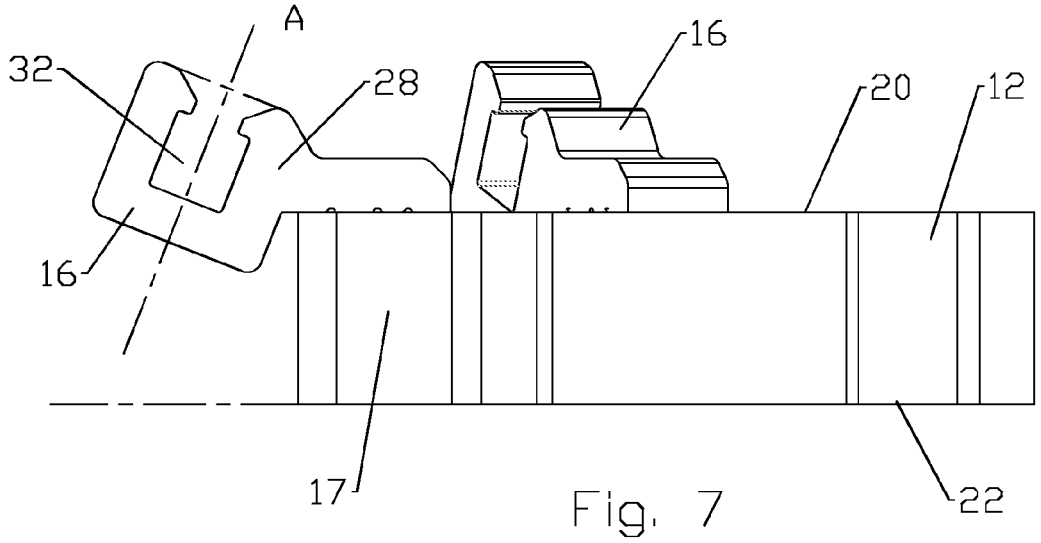
FIG. 7 is an enlarged side view of a portion of the mounting hub of FIG. 4.

As shown for example in FIGS. 3-7, an exemplary embodiment of an antenna hub comprises a frame 12 with a feed aperture 14. As best shown in FIGS. 3 and 7, a plurality of feet 16, here demonstrated as four feet 16, are coupled to the frame 12; each of the feet 16 provided with a dish fastener coupling axis "A" normal to a surface of the reflector dish 10 contacting each foot 16 when the reflector dish 10 is seated upon the feet 16, a feed bore 18 of the reflector dish 10 aligned coaxial with the feed aperture 14.

Where a standardized feed aperture 14 is applied, varying reflector dish diameters and/or curvature changes between different antenna configurations may be accommodated by changes to the dimensions and/or dish fastener coupling axis "A" alignment of the feet 16, without requiring changes to the frame 12.

Figure 10:
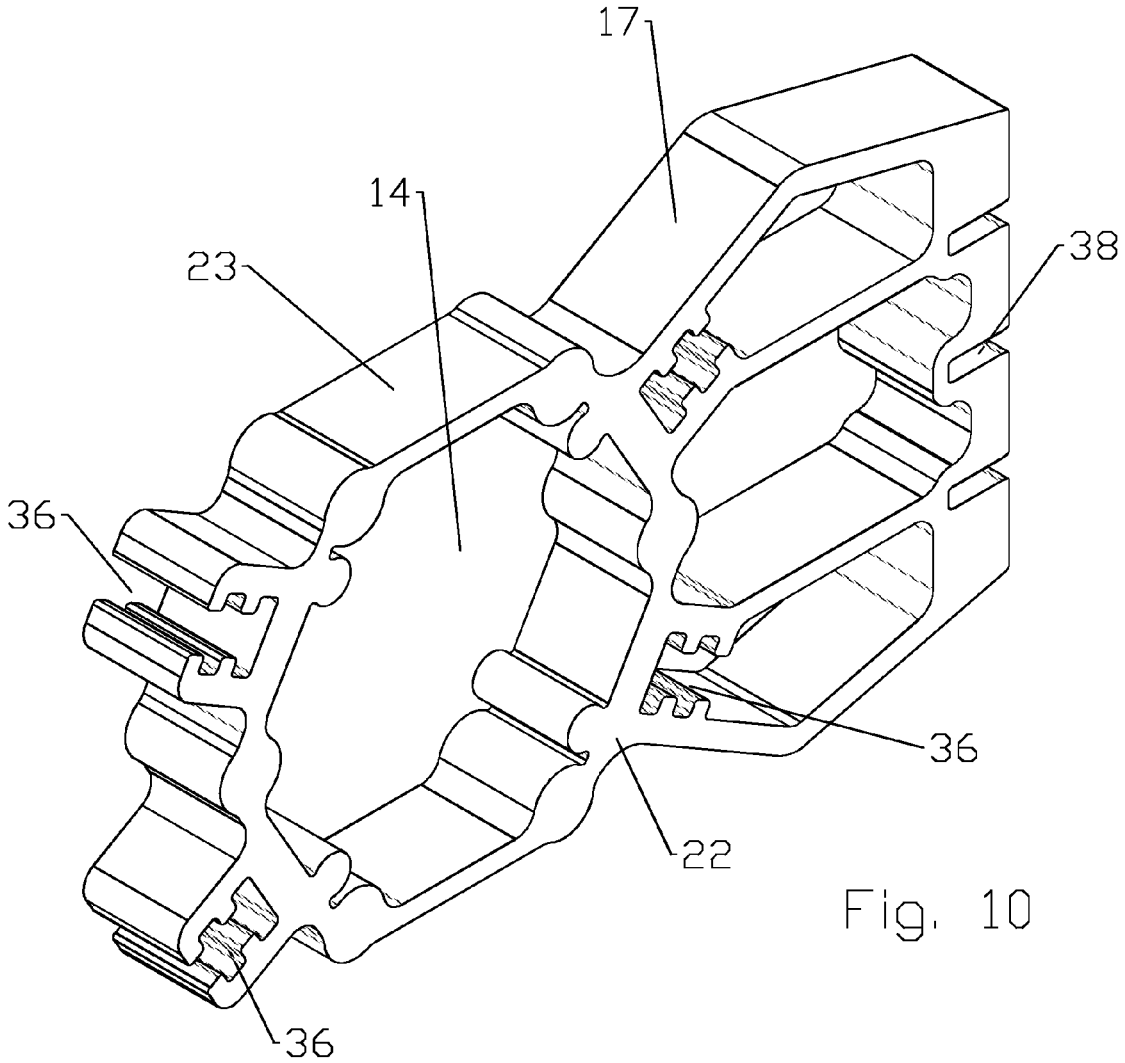
FIG. 10 is a schematic isometric view of a portion of an extrusion blank for the frame of FIG. 4.

One skilled in the art will appreciate that an extruded object is a cross-section that is extruded over a particular (extrusion) path. Thereby, sidewalls of the resulting unitary extruded object are each parallel to one another and the extrusion path. Similarly, the frame 12 and/or feet 16 may be cost efficiently formed by extrusion with a high level of precision. The raw extrusion blank 23 (see FIG. 10) of the desired cross-section may then be sliced at desired thicknesses along the cross-section to form a plurality of individual frame 12 and/or feet 16, each with a common cross-section, eliminating the prior procedure of extensive machining from solid blocks or casting pre-forms and the associated time and material waste expense.

Formed as an extrusion blank 23 and sliced at a desired extrusion depth to form individual unitary frame elements, each frame 12 may have a front frame surface 20 and a back frame surface 22, these surfaces planar and parallel to one another as a result of consecutive slices applied with a high level of precision along the raw extrusion blank 23 for example by a band saw, chop saw or the like. Similarly, a perimeter sidewall 17 between the front frame surface 20 and the back frame surface 22 may be normal to the front surface 20 and the back surface 22. An exemplary portion of an extrusion blank 23 is shown for example in FIG. 10. The extrusion blank 23 emitted from an extruder may be a continuous portion sliced in-line into the individual frames 12 as a step in the extrusion process or alternatively the frames 12 may be sliced at a later time from a supply of lengths of previously formed extrusion blank 23.

Further to the extrusion, additional bores, for example a plurality of feed support plate bores 24 and signal processing equipment mounting bores 26 may be drilled into the frame 12, for example as shown in FIG. 6, the feed support plate and signal processing equipment mounting bores 24,26 dimensioned to receive corresponding fasteners for retaining the respective elements to the frame 12.

The feet 16 may be similarly extruded and sliced to form individual foot elements, each foot 16 provided with a foot front surface 28 and a foot back surface 30. A dish nut slot 32, with a depth dimension parallel to the fastener coupling axis "A" may be provided for coupling between the feet 16 and reflector dish 10 via a fastener through the reflector dish 10 retained by a nut seated in the dish nut slot 32. As a feature of the foot cross-section, the dish nut slot width dimension between the foot front surface 28 and the foot back surface 30 will be parallel to a perimeter sidewall 17 of each of the feet 16. Alternatively, the feet 16 may be formed via casting, benefiting from the smaller cast tools required to cast the reduced dimension of the feet 16, compared to the frame 12. Bent sheet metal pieces may also be cost effectively applied as the feet 16. Further, rather than the dish nut slot structure, any of the feet 16 embodiments may utilize a bore drilled coaxially with the fastener coupling axis "A" for direct coupling with a fastener therein, for example via threading, self taping screws or riveting.

The coupling between the feet 16 and the frame 12 may be via foot tabs 34 of the feet 16 which mate with corresponding foot slots 36 of the frame 12, the foot slots 36 and foot tabs 34 provided, for example, normal to the front frame surface 20 of the frame 12 and the front foot surface 28 of each foot 16, respectively, as a further element of the frame 12 and foot 16 cross-sections. Thereby, the foot to frame interconnection functionality may be provided entirely via the extrusion and slicing processes, without requiring further manufacturing steps to form the interconnection features.

The foot 16 to frame 12 interconnections may be entirely via interference fit or alternatively with the assistance of an adhesive or additional mechanical fastener such as a rivet, pin, screw or the like.

Offset mounting of the mounting hub 8 to a mounting bracket 4 may be simplified by providing a base portion 38 of the frame 12 which extends away from the feed aperture 14, an end 40 of the base portion 38 providing a mount surface 42 along which the mounting hub 8 to mounting bracket 4 interconnection may be made. The dimensions of the mount surface 42 may be increased and thereby a required thickness of the frame 12 itself reduced, by providing a base 44, also formed, for example, via extrusion, coupled to the base portion 38 so that the base 44 and end 40 of the base portion 38 together form the mount surface 42, the mount surface 42, for example, aligned parallel to a longitudinal axis of the feed aperture 14.

The coupling between the base 44 and the base portion 38 may be applied via base tabs 46 of the base 44 which mate with base slots 48 of the base portion 38, for example as described with respect to the frame 12 and foot 16 interconnection. Thereby, the base to base portion interconnection functionality may be provided entirely via the extrusion and slicing processes, without requiring further manufacturing steps to form the interconnection features.

Figure 8:
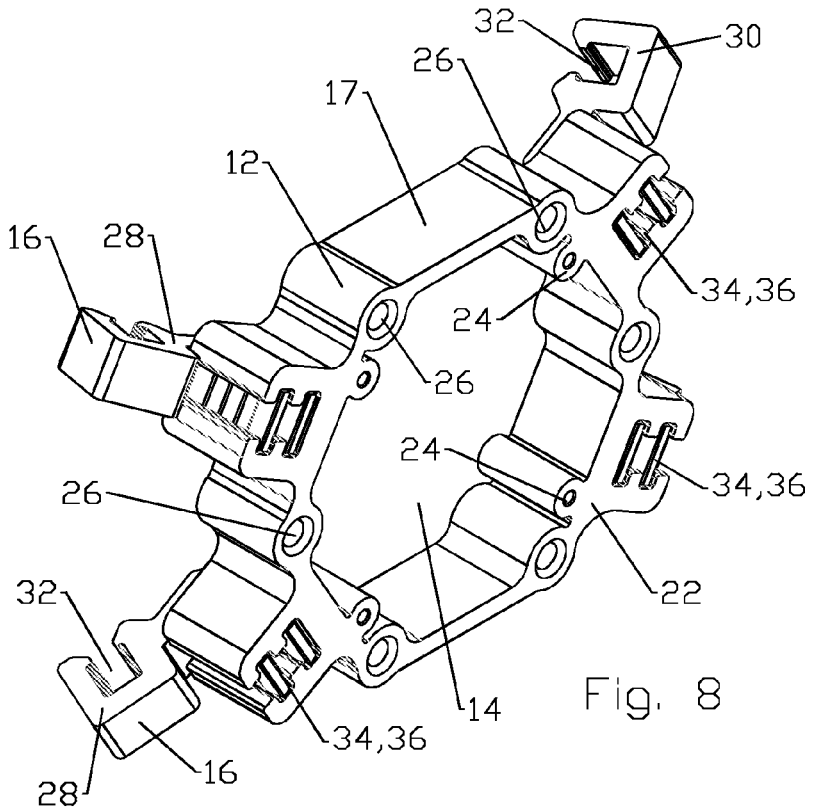
FIG. 8 is a schematic isometric view of an alternative embodiment of a mounting hub.
Figure 9:
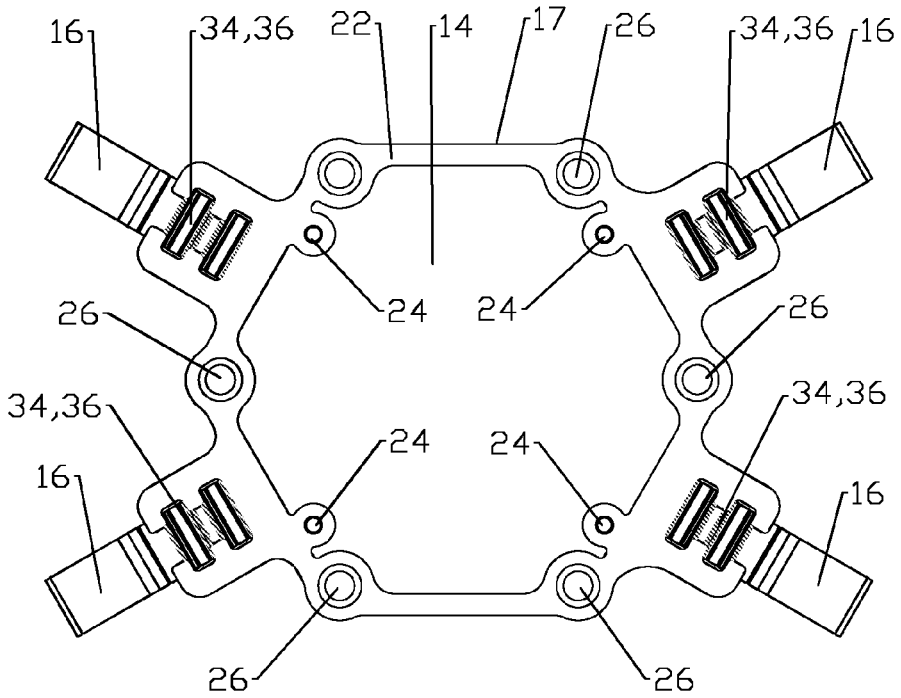
FIG. 9 is a schematic back end view of the mounting hub of FIG. 8.

Alternatively, the frame 12 may be applied without a mounting bracket interconnection, for example as shown in FIGS. 8 and 9, where the reflector antenna assembly may be supported via another interconnection with the reflector dish 10 or via connections with the structure of attached signal processing equipment.

One skilled in the art will appreciate that the frame 12, feet 16 and base 44 (if present), may be cost effectively formed as extrusions that are then cut to length and necessary holes bored/threaded. A range of different feet 16 may be applied to mate with the same frame 12, enabling new reflector dish 10 dimension and/or curvature configurations to be adapted for with only re-tooling of the simplified foot extrusion die required, which may significantly improve the speed of the design cycle for new antenna models and/or reduce the total number of unique parts maintained in inventory.

Further, the extrusions may be easily modeled as two-dimensional structures, enabling precise calculation of necessary material thicknesses corresponding to the expected loads of each portion of the structure, enabling overall material reductions which reduce both material costs and the weight of the resulting mounting bracket 4.

Table of Parts

| | |
|---|---|
| 4 | mounting bracket |
| 6 | reflector antenna |
| 8 | mounting hub |
| 10 | reflector dish |
| 12 | frame |
| 14 | feed aperture |
| 16 | foot |
| 17 | perimeter sidewall |
| 18 | feed bore |
| 20 | front frame surface |
| 22 | back frame surface |
| 23 | extrusion blank |
| 24 | feed support plate bore |
| 26 | signal processing equipment bore |
| 28 | front foot surface |
| 30 | back foot surface |
| 32 | dish nut slot |
| 34 | foot tab |
| 36 | foot slot |
| 38 | base portion |
| 40 | end |
| 42 | mount surface |
| 44 | base |
| 46 | base tab |
| 48 | base slot |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An antenna hub for a reflector dish with a feed bore, comprising:

a frame with a feed aperture;

a plurality of feet coupled to the frame; each of the feet provided with a dish fastener coupling axis normal to a dish surface contacting each of the feet when the reflector dish is seated upon the feet, the feed bore of the reflector dish aligned coaxially with the feed aperture.

2. The antenna hub of claim 1, wherein the frame is extruded between a front frame surface and a back frame surface.

3. The antenna hub of claim 1, wherein the feet are extruded between a foot front surface and a foot back surface.

4. The antenna hub of claim 1, wherein each of the feet are provided with a dish nut slot, a depth dimension of the dish nut slot parallel to the fastener coupling axis and a width dimension of the dish nut slot parallel to a foot perimeter sidewall of each of the feet.

5. The antenna hub of claim 1, wherein a front frame surface of the frame is planar and a back frame surface of the frame is planar; the front frame surface and the back frame surface parallel to one another.

6. The antenna hub of claim 1, wherein a frame perimeter sidewall between the front frame surface and the back frame surface is normal to the front surface and the back surface.

7. The antenna hub of claim 1, wherein the feet are coupled to the frame via foot tabs which mate with foot slots of the frame, the foot slots provided normal to a front frame surface of the frame.

8. The antenna hub of claim 1, wherein the plurality of feet is four feet.

9. The antenna hub of claim 1, wherein the frame is a unitary portion of material.

10. The antenna hub of claim 1, further including a base portion of the frame extending away from the feed aperture;

a base coupled to the base portion and an end of the base portion together comprising a mount surface parallel to a longitudinal axis of the feed aperture.

11. The antenna hub of claim 1, wherein the base is coupled to the base portion via base tabs of the base which mate with base slots of the base portion.

12. A method of manufacturing an antenna hub for a reflector dish with a feed bore, comprising the steps of:

extruding an extrusion blank and slicing a frame with a feed aperture therefrom;

providing a plurality of feet;

coupling the plurality of feet to the frame;

each of the feet provided with a dish fastener coupling axis normal to a dish surface contacting each of the feet when the reflector dish is seated upon the feet, the feed bore of the reflector dish aligned coaxially with the feed aperture.

13. The method of claim 12, wherein the coupling between the feet and the frame is via foot tabs which seat within foot slots of the frame, the foot slots provided normal to a front frame surface of the frame.

14. The method of claim 12, wherein each of the feet are provided with a dish nut slot, a depth dimension of the dish nut slot parallel to the fastener coupling axis and a width dimension of the dish nut slot parallel to a foot perimeter sidewall of each of the feet.

15. The method of claim 12, wherein a front frame surface of the frame is planar and a back frame surface of the frame is planar; the front frame surface and the back frame surface parallel to one another.

16. The method of claim 12, wherein a frame perimeter sidewall between the front frame surface and the back frame surface is normal to the front surface and the back surface.

17. The method of claim 12, further including a base portion of the frame extending away from the feed aperture;

a base coupled to the base portion and an end of the base portion together comprising a mount surface parallel to a longitudinal axis of the feed aperture.

18. The method of claim 12, wherein the base is coupled to the base portion via base tabs of the base which mate with base slots of the base portion.

19. The method of claim 12, wherein the coupling is via an interference fit.

20. The method of claim 12, wherein the coupling is via an adhesive.

* * * * *